US008199091B2

(12) United States Patent
Ker et al.

(10) Patent No.: US 8,199,091 B2
(45) Date of Patent: Jun. 12, 2012

(54) GAMMA VOLTAGE CONVERSION DEVICE

(75) Inventors: Ming-Dou Ker, Hsin-Chu (TW); Shao-Chi Chen, Hsin-Chu (TW); Yu-Hsuan Li, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 694 days.

(21) Appl. No.: 12/371,629

(22) Filed: Feb. 16, 2009

(65) Prior Publication Data

US 2010/0097306 A1 Apr. 22, 2010

(30) Foreign Application Priority Data

Oct. 22, 2008 (TW) ..... 97140404 A

(51) Int. Cl.
*G09G 3/36* (2006.01)

(52) U.S. Cl. ..... 345/89; 345/94; 345/204; 345/210; 345/211; 349/41

(58) Field of Classification Search ..... 345/87, 345/89, 94, 204, 210, 211; 349/41
See application file for complete search history.

(56) References Cited

U.S. PATENT DOCUMENTS

| | | | | |
|---|---|---|---|---|
| 6,411,273 | B1 * | 6/2002 | Nakamura et al. | 345/98 |
| 6,593,934 | B1 * | 7/2003 | Liaw et al. | 345/590 |
| 7,248,254 | B2 * | 7/2007 | Kato | 345/204 |
| 2002/0003521 | A1 * | 1/2002 | Matsueda et al. | 345/89 |
| 2003/0122754 | A1 * | 7/2003 | Bu | 345/87 |
| 2005/0057482 | A1 * | 3/2005 | Youngblood et al. | 345/100 |
| 2009/0040212 | A1 * | 2/2009 | Wang | 345/214 |
| 2009/0046083 | A1 * | 2/2009 | Kim et al. | 345/204 |

* cited by examiner

*Primary Examiner* — Wayne Young
*Assistant Examiner* — Linh Nguyen
(74) *Attorney, Agent, or Firm* — Winston Hsu; Scott Margo

(57) ABSTRACT

Gamma voltage conversion device includes a gamma voltage conversion circuit, an amplifier, and a gamma voltage adjusting circuit. The gamma voltage conversion circuit generates a first gamma voltage conformed to a first gamma curve according to a grey level. The amplifier includes a first input end receiving the first gamma voltage, a second end, and an output end. The amplifier outputs the first or a second gamma voltage conformed to a second gamma curve according to the grey level according to the first and the second ends of the amplifier. The gamma voltage adjusting circuit coupled between the second input end and the output end of the amplifier controls the amplifier to output the first or the second gamma voltage as the gamma driving voltage according to the grey level and a gamma curve selection signal.

13 Claims, 8 Drawing Sheets

GAMMA VOLTAGE CONVERSION DEVICE

BACKGROUND OF THE INVENTION

1. Field of the Invention

The present invention relates to a gamma voltage conversion device, and more particularly, to a gamma voltage conversion device capable of transforming a gray level signal to be a gamma voltage conformed to a gamma curve or another gamma curve.

2. Description of the Prior Art

Please refer to FIG. 1. FIG. 1 is a diagram illustrating a gamma curve. In FIG. 1 the gamma curve gamma A is applied for a 3-volt LCD panel, the horizontal axis represents the gray level signal $D_{IN}$, the vertical axis represents the gamma driving voltage $V_{OUT}$, and the gray level signal $D_{IN}$ is a 6-bit digital signal. Therefore, according to the gamma curve gamma A shown in FIG. 1, the magnitude of the gamma driving voltage $V_{OUT}$ corresponding to the gray level signal $D_{IN}$ can be derived for driving the 3-volt LCD panel.

However, the conventional gamma conversion device is only capable of converting the gray level signal $D_{IN}$ to the gamma driving voltage $V_{OUT}$, which is only conformed to one gamma curve (gamma A). However, not all of the gamma curves, applied for the LCD panels of other types, are the same as the gamma curve gamma A. For instance, a gamma curve gamma B is applied for a 5-volt LCD panel. Hence, the conventional gamma conversion device can only applied for the 3-volt LCD panel but not for the 5-volt LCD panel, causing a great inconvenience.

SUMMARY OF THE INVENTION

The present invention provides a gamma voltage conversion device for generating a gamma driving voltage according to a gray level signal. The gray level signal and the gamma driving voltage are conformed to a first gamma curve or a second gamma curve. The gamma voltage conversion device comprises a gamma voltage conversion circuit, an operational amplifier, and a gamma voltage adjusting circuit. The gamma voltage conversion circuit is utilized for generating a first gamma voltage according to the gray level signal. The gray level signal and the first gamma voltage are conformed to the first gamma curve. The operational amplifier comprises a first input end coupled to the gamma voltage conversion circuit for receiving the first gamma voltage, a second input end, and an output end. The operational amplifier outputs the first gamma voltage or a second gamma voltage as the gamma driving voltage according to the first input end of the operational amplifier and the second input end of the operational amplifier. The gray level signal and the second gamma voltage are conformed to the second gamma curve. The gamma voltage adjusting circuit is coupled between the second input end of the operational amplifier and the output end of the operational amplifier for controlling the operational amplifier outputting the first gamma voltage or the second gamma voltage as the gamma driving voltage according to the gray level signal and a gamma curve selection signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
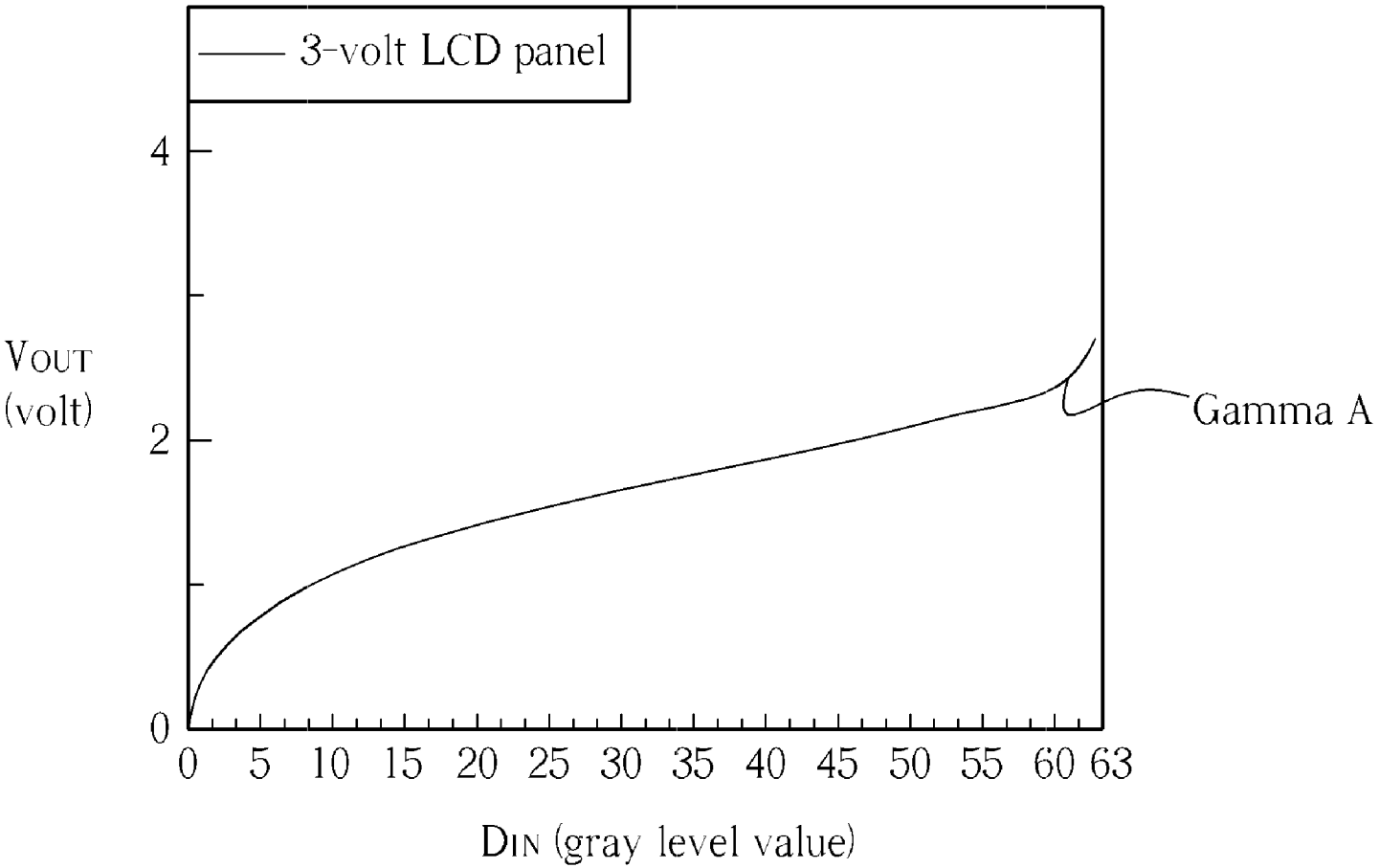
FIG. 1 PRIOR ART
FIG. 1 is a diagram illustrating a gamma curve.
Figure 2:
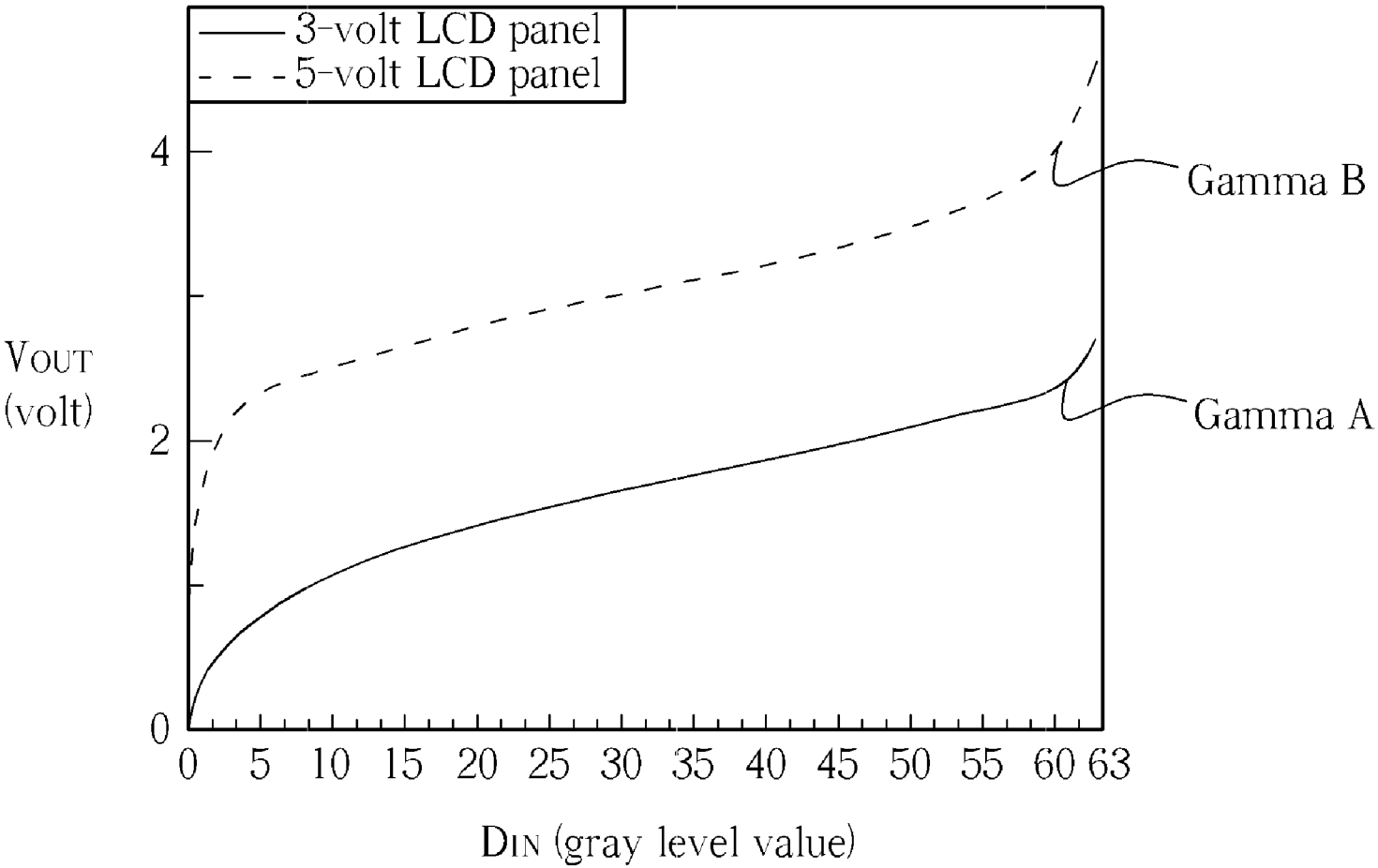
FIG. 2 is a diagram illustrating two different gamma curves.

Please refer to FIG. 2. FIG. 2 is a diagram illustrating two gamma curves. In FIG. 2, the gamma curve gamma A is applied for a 3-volt LCD panel and the gamma curve gamma B is applied for a 5-volt LCD panel. The horizontal axis represents the gray level signal $D_{IN}$ and the vertical axis represents the gamma driving voltage $V_{OUT}$, wherein the gray level signal $D_{IN}$ is a 6-bit digital signal. As a result, according to the gamma curve gamma A shown in FIG. 2, the magnitude of the gamma driving voltage $V_{OUT}$ corresponding to the gray level signal $D_{IN}$ can be derived so as to drive the 3-volt LCD panel. In addition, according to the gamma curve gamma B shown in FIG. 2, the magnitude of the gamma driving voltage $V_{OUT}$ corresponding to the gray level signal $D_{IN}$ can be derived as well so as to drive the 5-volt LCD panel.

Figure 3:
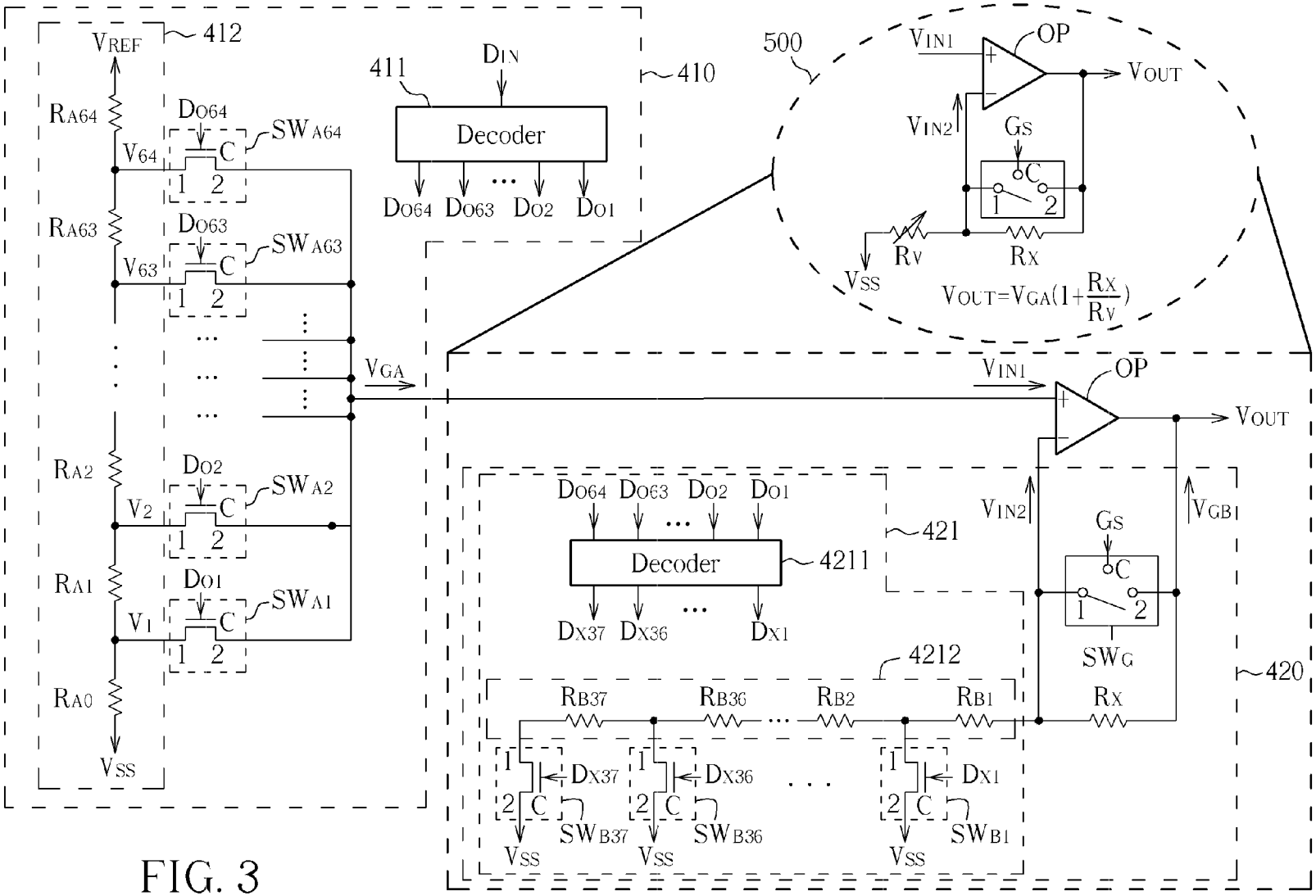
FIG. 3 is a diagram illustrating the gamma voltage conversion device of the present invention.

Please refer to FIG. 3. FIG. 3 is a diagram illustrating the gamma voltage conversion device 400 of the present invention. As shown in FIG. 3, the gamma voltage conversion device 400 comprises a gamma voltage conversion circuit 410, a gamma voltage adjusting circuit 420, and an operational amplifier OP. According to the requirement, the gamma voltage conversion device 400 can selects the proper gamma curve, gamma A or gamma B, so as to output the suitable gamma voltage for driving the 3-volt LCD panel or the 5-volt LCD panel.

The gamma voltage conversion circuit 410 is utilized for, according to a gray level signal $D_{IN}$, outputting a gamma voltage $V_{GA}$ conformed to the gamma curve gamma A, as the input voltage $V_{IN1}$, to the operational amplifier OP. The gray level signal $D_{IN}$ abovementioned is a 6-bit digital signal, for example. The gamma voltage conversion circuit 410 comprises a decoder 411, sixty-four switches $SW_{A1}$~$SW_{A64}$ and a resistor series 412.

The resistor series 412 is coupled between a reference voltage source $V_{REF}$ and a constant voltage source $V_{SS}$ (a ground end). The resistor series 412 comprises sixty-five resistors $R_{A0}$~$RA_{64}$ connected in series, wherein every resistor has a predetermined resistance for providing a resistor partial voltage (the resistor partial voltages $V_1$~$V_{64}$ are shown in FIG. 3, and therefore totally sixty-four resistor partial voltages are provided). The relation between the resistor partial voltages provided by the resistors and the corresponding gray level signals are conformed to the gamma curve gamma A. For instance, when the gray level signal $D_{IN}$ is [000000], according to the gamma curve gamma A, the corresponding resistor partial voltage is $V_1$. When the gray level signal $D_{IN}$ is [000001], the corresponding resistor partial voltage, according to the gamma curve gamma A, is $V_2$. When the gray level signal $D_{IN}$ is [111111], the corresponding resistor partial voltage, according to the gamma curve gamma A, is $V_{64}$.

The decoder 411 is utilized for receiving the gray level signal $D_{IN}$ and accordingly decoding the received gray level signal $D_{IN}$ to be the decoded signal $D_{O1}$~$D_{O64}$ with the corresponding values. As described above, the gray level signal $D_{IN}$ is a 6-bit signal. When the gray level signal $D_{IN}$ is [000000], only the decoded signal $D_{O1}$ is logic "1" and the rest decoded signals are logic "0". When the gray level signal $D_{IN}$ is [111111], only the decoded signal $D_{O64}$ is logic "1" and the rest decoded signals are logic "0".

The switches $SW_{A1}$~$SW_{A64}$ are utilized for transmitting the resistor partial voltage provided by the resistor series 412 to the operational amplifier OP according to the decoded signals $D_{O1}$~$D_{O64}$ of the decoder 411, respectively. Each of the switches $SW_{A1}$~$SW_{A64}$ comprises a first end 1, a second end 2 and a control end C. Each first end of the switch $SW_{A1}$~$SW_{A64}$ is coupled to the corresponding resistor in the resistor series 212 for receiving the corresponding resistor partial voltage. Each second end 2 of the switches $SW_{A1}$~$SW_{A64}$ is coupled to a first input end (the positive input end) of the operational amplifier OP for transmitting the received resistor partial voltage (the gamma voltage $V_{GA}$ outputted by the gamma voltage conversion circuit 410) to the operational OP as the input voltage $V_{IN1}$. Each control end C of the switches $SW_{A1}$~$SW_{A64}$ is coupled to the corresponding output end of the decoder 411 for receiving the corresponding decoded signal so as to accordingly control the first ends 1 of the switches $SW_{A1}$~$SW_{A64}$ coupling to the second ends 2, respectively. More particularly, all the switches $SW_{A1}$~$SW_{A64}$ are short-circuited to the first input end of the operational amplifier OP. For example, when the gray level signal $D_{IN}$ is [000000], only the decoded signal $D_{O1}$ is logic "1" and the rest decoded signals are logic "0", and therefore, only the switch $SW_{A1}$ is turned on so as to transmit the resistor partial voltage $V_1$ to the first input end of the operational amplifier OP. It means that the gamma voltage $V_{GA}$ outputted by the gamma voltage conversion circuit 410 is $V_1$ and is served as the input voltage $V_{IN1}$ for the operational amplifier OP. When the gray level signal $D_{IN}$ is [000001], only the decoded signal $D_{O2}$ is logic "1" and the rest decoded signals are logic "0", and therefore, only the switch $SW_{A2}$ is turned on so as to transmit the resistor partial voltage $V_2$ to the first input end of the operational amplifier OP. It means that the gamma voltage $V_{GA}$ outputted by the gamma voltage conversion circuit 410 is $V_2$ and is served as the input voltage $V_{IN1}$ for the operational amplifier OP. When the gray level signal $D_{IN}$ is [111111], only the decoded signal $D_{O64}$ is logic "1" and the rest decoded signals are logic "0", and therefore, only the switch $SW_{A64}$ is turned on so as to transmit the resistor partial voltage $V_{64}$ to the first input end of the operational amplifier OP. It means that the gamma voltage $V_{GA}$ outputted by the gamma voltage conversion circuit 410 is $V_{64}$ and is served as the input voltage $V_{IN1}$ for the operational amplifier OP.

The operational amplifier OP comprises a first input end (the positive input end), a second input end (the negative input end) and an output end. The first input end (the positive input end) of the operational amplifier OP is utilized for receiving the input voltage $V_{IN1}$. The second end (the negative input end) of the operational amplifier OP is utilized for receiving the input voltage $V_{IN2}$. The output end of the operational amplifier OP is utilized for outputting the gamma driving voltage $V_{OUT}$. In FIG. 3, the input voltage $V_{IN1}$ is equal to the gamma voltage $V_{GA}$ outputted from the gamma conversion circuit 410. Because of the characteristic of the operational amplifier OP, the input voltage $V_{IN1}$ on the first input end (the positive input end) is actually equal to the input voltage $V_{IN2}$ on the second input end (the negative input end).

The gamma voltage conversion circuit 420 comprises a gamma curve selection switch $SW_G$, a resistor $R_X$, and a variable resistance circuit 421.

The variable resistance circuit 421 comprises a decoder 4211, a resistor series 4212, and thirty-seven switches $SW_{B1}$~$SW_{B37}$.

The decoder 4211 is utilized for generating the decoded signals $D_{X1}$~$D_{X37}$ according to the decoded signals $D_{O1}$~$D_{O64}$ decoded from the decoder 411.

The switches $SW_{B1}$~$SW_{B37}$ are utilized for, according the decoded signals $D_{X1}$~$D_{X37}$ decoded from the decoder 4211, controlling the equivalent resistance of the resistor series 4212 to the operational amplifier OP. More precisely, the resistor series 4212 can be treated as a variable resistor $R_V$, coupled between the second input end of the operational amplifier OP and the voltage source $V_{SS}$ (the ground end). The switches $SW_{B1}$~$SW_{B37}$ are utilized for controlling the resistance of the variable resistor $R_V$. Each of the switches $SW_{B1}$~$SW_{B37}$ comprises a first end 1, a second end 2 and a control end C. Each first end 1 of the switches $SW_{B1}$~$SW_{B37}$ is coupled to the corresponding resistor in the resistor series 4212. Each second end 2 of the switches $SW_{B1}$~$SW_{B37}$ is coupled to the voltage source $V_{SS}$ (the ground end). Each control end C of the switches $SW_{B1}$~$SW_{B64}$ is coupled to the corresponding output end of the decoder 4211 for receiving the decoded signal so as to control the first ends 1 of the switches $SW_{B1}$~$SW_{B37}$ coupling to the second ends 2 of the switches $SW_{B1}$~$SW_{B37}$, respectively.

The resistor series 4212 is coupled between the second input end (the negative input end) of the operational amplifier OP and the switches $SW_{B1}$~$SW_{B37}$. The resistor series 4212 comprises thirty-seven resistors $R_{B1}$~$R_{B37}$ connected in series, wherein each resistor has a predetermined resistance. As described above, the resistor series 4212 can be treated as a variable resistor $R_V$ coupled between the second input end (the negative input end) of the operational amplifier OP and the voltage source $V_{SS}$ (the ground end). The switches $SW_{B1}$~$SW_{B37}$ are utilized for controlling the resistance of the variable resistor $R_V$. For instance, when the decoded signal $D_{X1}$ is logic "1", the switch $SW_{B1}$ is turned on so that the resistance of the variable resistor $R_V$ is equal to the resistance of the resistor $R_{B1}$. When the decoded signal $D_{X2}$ is logic "1", the switch $SW_{B2}$ is turned on so that the resistance of the variable resistor $R_V$ is equal to the sum of the resistances of the resistors ($R_{B1}$+$R_{B2}$). When the decoded signal $D_{X3}$ is logic "1", the switch $SW_{B3}$ is turned on so that the resistance of the variable resistor $R_V$ is equal to the sum of the resistances of the resistors ($R_{B1}$+$R_{B2}$+$R_{B3}$). When the decoded signal $D_{X37}$ is logic "1", the switch $SW_{B37}$ is turned on so that the resistance of the variable resistor $R_V$ is equal to the sum of the resistances of the resistors ($R_{B1}$+$R_{B2}$+$R_{B3}$+ . . . +$R_{B37}$).

The resistor $R_X$ is coupled between the output end of the operational amplifier OP and the second input end (the negative input end) of the operational amplifier OP. The gamma curve selection switch $SW_G$ is also coupled between the output end of the operational amplifier OP and the second input end (the negative input end) of the operational amplifier OP. According to the gamma curve selection signal $G_S$, the gamma curve selection switch $SW_G$ determines if the output end of the operation amplifier OP is short-circuited to the second input end (the negative input end) of the operational amplifier. If the gamma curve selection switch $SW_G$ determines the output end of the operation amplifier OP is short-circuited to the second input end (the negative input end) of the operational amplifier OP, the gamma voltage conversion device 400 of the present invention outputs the gamma driving voltage $V_{OUT}$ conformed to the gamma curve gamma A for driving the 3-volt LCD panel. If the gamma curve selection switch $SW_G$ determines the output end of the operation amplifier OP is not short-circuited to the second input end (the negative input end) of the operational amplifier OP, the gamma voltage conversion device 400 of the present invention outputs the gamma driving voltage $V_{OUT}$ conformed to the gamma curve gamma B for driving the 5-volt LCD panel. The operating principle is illustrated as below.

Please continue referring to FIG. 3. In FIG. 3, the gamma voltage conversion circuit 420 and the operational amplifier can be treated as a voltage conversion circuit 500. When the gamma curve selection switch $SW_G$ determines that the output end of the operational amplifier OP is short-circuited to the second input end of the operational amplifier OP, the gamma voltage conversion device 400 of the present invention therefore can be treated as the conventional gamma voltage conversion device 200 so as to transform the gray level signal $D_{IN}$ to be the gamma driving voltage $V_{OUT}$, in the way conformed to the gamma curve gamma A, to drive the 3-volt LCD panel. Furthermore, when the gamma curve selection switch $SW_G$ determines that the output end of the operational amplifier OP is not short-circuited to the second input end of the operational amplifier OP, the gamma driving voltage $V_{OUT}$ outputted by the gamma voltage conversion device 400 of the present invention can be derived according to the following formulas:

$$V_{OUT}=[1+(R_X/R_V)]\times V_{IN2} \quad (1);$$

$$V_{IN2}=V_{IN1} \quad (2);$$

$$V_{IN1}=V_{GA} \quad (3);$$

where $V_{IN2}$ represents the voltage on the second input end (the negative input end) of the operational amplifier OP. In such way, according to the resistance of the variable resistor $R_V$, the gamma driving voltage $V_{OUT}$ can be adjusted to be conformed to the gamma curve gamma B. Since the resistance of the variable resistor $R_V$ is controlled by the decoded signals $D_{X1}$~$D_{X37}$, which are decoded from the decoder 4211 according to the decoded signals $D_{O1}$~$D_{O64}$ decoded from the gray level signal $D_{IN}$, the gamma driving voltage $V_{OUT}$ adjusted by the variable resistor $R_V$ is ensured to be conformed to the gamma curve gamma B so as to drive the 5-volt LCD panel.

In addition, it is noticeable that since the gray level signal is a 6-bit signal, the resistor series 412 requires sixty-four ($2^6$) resistors for generating the gamma voltage $V_{GA}$ corresponding to each level of the gray level signal according to the gamma curve gamma A. Theoretically, the resistor series 4212 of the present invention should require the same number of resistors connected in series. However, in the 6-bit gray level signal $D_{IN}$, some levels correspond to the same resistance of the variable resistor $R_V$. As a result, the resistor series 4212 and the decoder 4211 do not require the same number of resistors, switches and decoded signals for effectively transforming each level of the 6-bit gray level signal $D_{IN}$ to be the gamma driving voltage $V_{OUT}$ conformed to the gamma curve gamma B so as to drive the 5-volt LCD panel.

Figure 4:
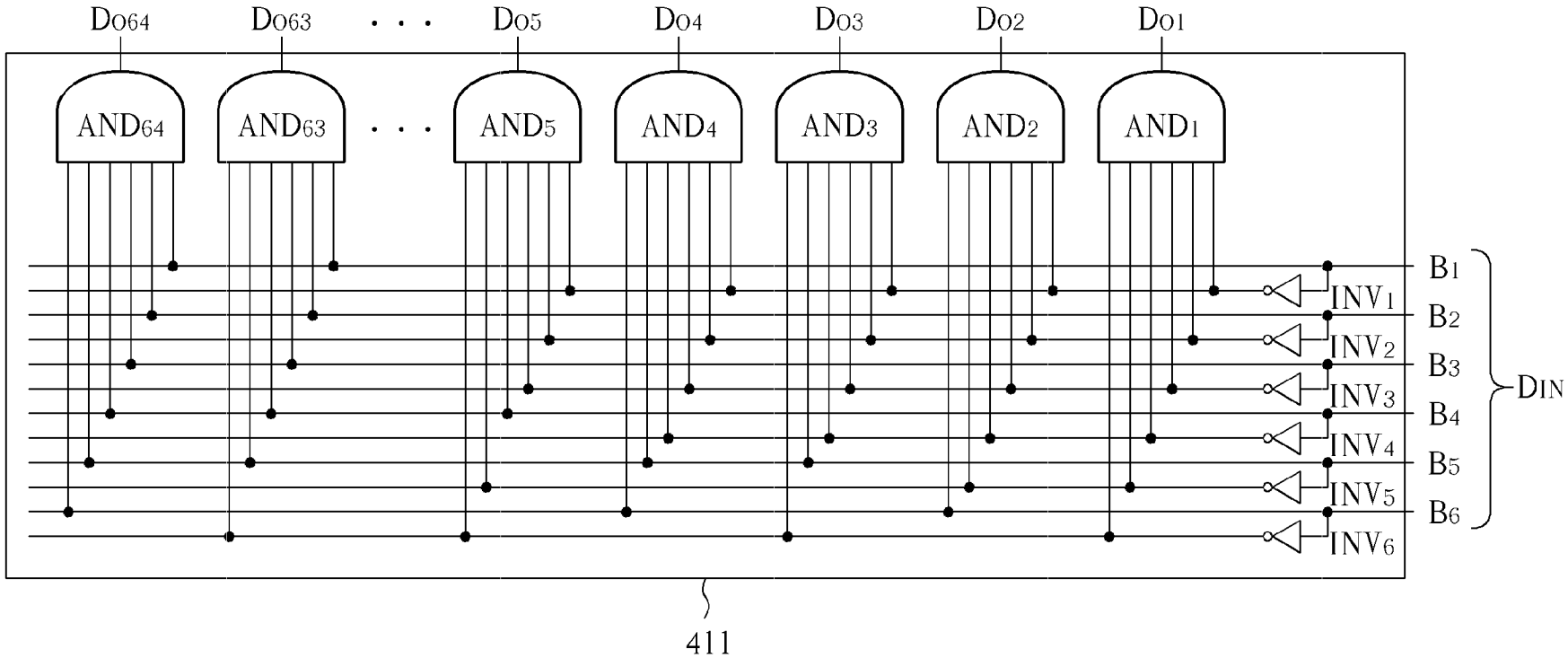
FIG. 4 is a diagram illustrating an embodiment of the decoder of the present invention.

Please refer to FIG. 4. FIG. 4 is a diagram illustrating an embodiment of the decoder 411 of the present invention. As shown in FIG. 4, the decoder 411 can be realized with sixty-four AND gates $AND_1$~$AND_{64}$ and six inverters $INV_1$~$INV_6$. In this way, the decoder 411 can correctly decode the decoded signals $D_{O1}$~$D_{O64}$ as required according to the 6-bit ($B_1$, $B_2$, $B_3$, $B_4$, $B_5$, $B_6$) gray level signal $D_{IN}$.

Figure 5:
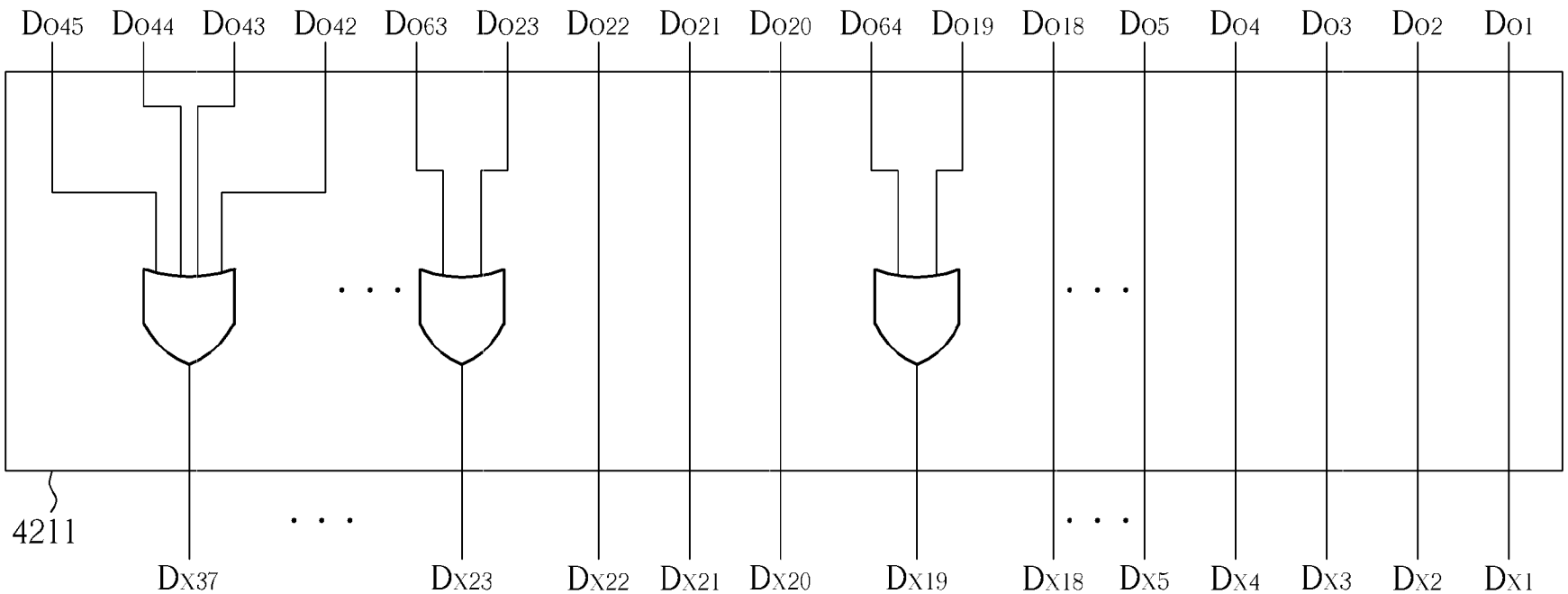
FIG. 5 is a diagram illustrating an embodiment of another decoder of the present invention.

Please refer to FIG. 5. FIG. 5 is a diagram illustrating an embodiment of the decoder 4211 of the present invention. As shown in FIG. 5, the decoder 4211 can be realized with a plurality of OR gates. In this way, the decoder 4211 can correctly decode the decoded signal $D_{O1}$~$D_{O64}$ as required according to the decoded signals $D_{X1}$~$D_{X37}$.

Figure 6:
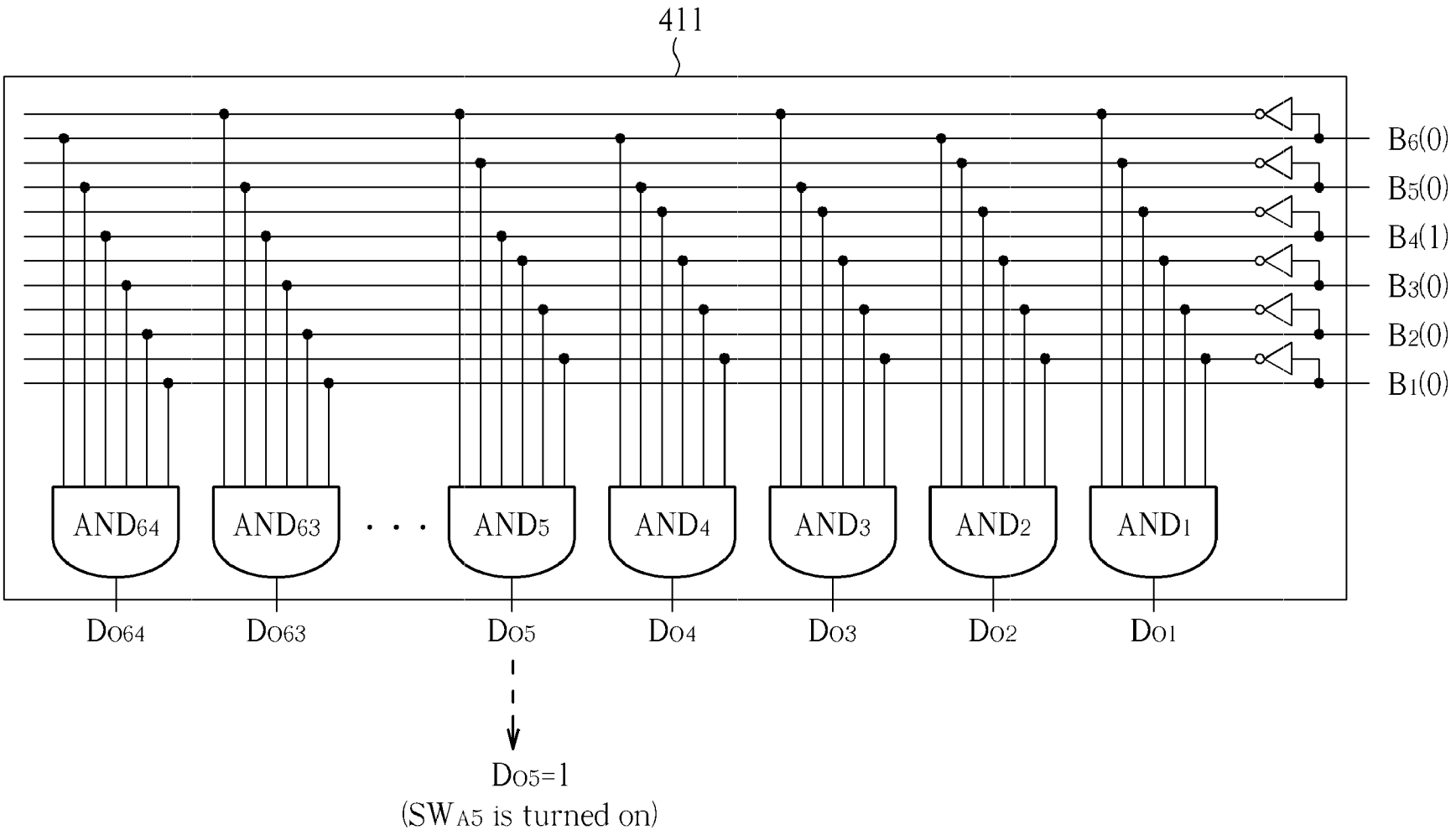
FIG. 6, FIG. 7 and FIG. 8 are diagrams illustrating the operating principle when a gray level signal is inputted to the gamma voltage conversion device of the present invention.
Figure 7:
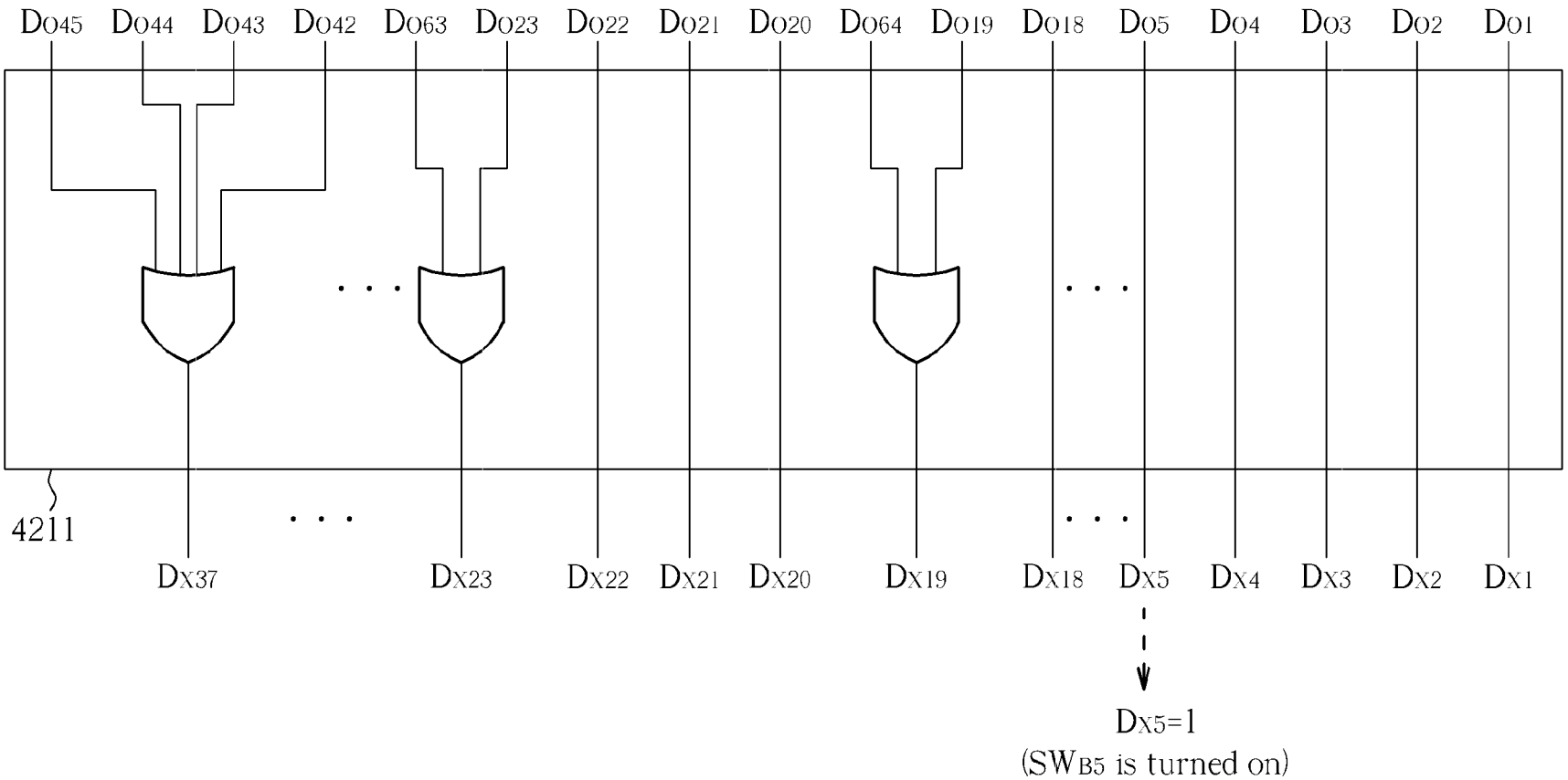
Figure 8:
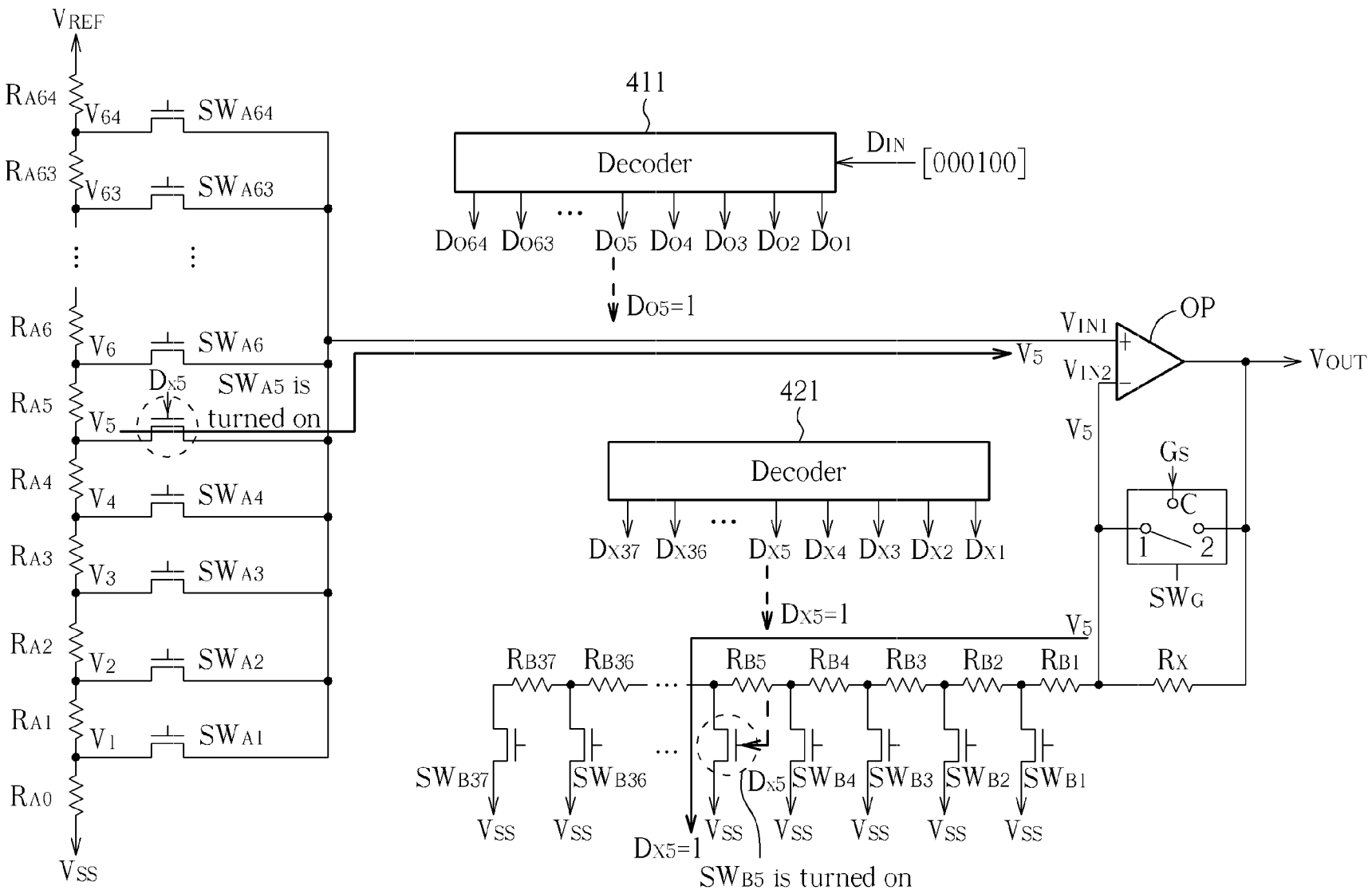

Please refer to FIG. 6, FIG. 7 and FIG. 8. FIG. 6, FIG. 7 and FIG. 8 are diagrams illustrating the operating principle when a gray level signal is inputted to the gamma voltage conversion device 400 of the present invention. In FIG. 6, FIG. 7 and FIG. 8, the input gray level signal $D_{IN}$ is set as [000100]. In FIG. 6, it can be seen that when the gray level signal $D_{IN}$ is [000100], among the decoded signals decoded from the decoder 411, only the decoded signal $D_{O5}$ is logic "1". Therefore, in the gamma voltage conversion circuit 410, the switch $SW_{A5}$ is turned on to output the resistor partial voltage $V_5$, which the resistor series 412 corresponds to, as the gamma voltage $V_{GA}$. The gamma voltage $V_{GA}$ is then transmitted to the first input end of the operational amplifier OP as the input voltage $V_{IN1}$. In FIG. 7, it can be seen that only when the decoded signal $D_{O5}$ is logic "1", among the decoded signals decoded from the decoder 411, only the decoded signal $D_{X5}$ is logic "1". Thus, in the gamma voltage adjusting circuit 420, the switch $SW_{B5}$ is turned on so that the resistor, which the resistor series 4212 corresponds to, becomes ($R_{B1}$+$R_{B2}$+$R_{B3}$+$R_{B4}$+$R_{B5}$) so as to be served as the resistance of the variable resistor $R_V$. Hence, in FIG. 8, if the gamma curve selection switch $SW_G$ determines that the output end of the operational amplifier OP is short-circuited to the second end of the operational amplifier OP, the gamma voltage conversion device 400 of the present invention outputs the gamma driving voltage $V_{OUT}$ with a magnitude of $V_5$, wherein the gamma driving voltage $V_{OUT}$ with a magnitude of $V_5$ and the gray level signal $D_{IN}$ with a value of [000100] are conformed to the gamma curve gamma A. On the contrary, if the gamma curve selection switch $SW_G$ determines that the output end of the operational amplifier OP is not short-circuited to the second end of the operational amplifier OP, the gamma driving voltage $V_{OUT}$ outputted by the gamma voltage conversion device 400 of the present invention can be calculated out according to the formulas (1), (2) and (3) as below:

$$V_{IN1}=V_{GA}=V_5 \quad (1);$$

$$V_{IN2}=V_{IN1} \quad (2);$$

$$V_{OUT}=[1+(R_X/R_V)]\times V_{IN2}=[1+R_X/(R_{B1}+R_{B2}+R_{B3}+R_{B4}+R_{B5})]\times V_5 \quad (3);$$

the gamma driving voltage $V_{OUT}$ and the gray level signal $D_{IN}$ with the value of [001000] derived according to the formulas above, are conformed to the gamma curve gamma B.

In summary, by means of the gamma voltage conversion device provided by the present invention, the gamma curves can be selected as required so as to drive various LCD panels. It is not necessary to redesign gamma voltage conversion device when the type of LCD panel is changed, which reduces the cost of manufacture and causes great convenience.

Those skilled in the art will readily observe that numerous modifications and alterations of the device and method may be made while retaining the teachings of the invention.

What is claimed is:

1. A gamma voltage conversion device for generating a gamma driving voltage according to a gray level signal, the gray level signal and the gamma driving voltage are conformed to a first gamma curve or a second gamma curve, the gamma voltage conversion device comprising:

a gamma voltage conversion circuit for generating a first gamma voltage according to the gray level signal, comprising:

a first decoder for receiving the gray level signal so as to accordingly generate a plurality of first decoded signals;

a first resistor series, coupled between a reference voltage source and a ground end, the first resistor series comprising a plurality of resistors connected in series;

wherein each resistor of the plurality of the resistors of the first resistor series has a predetermined resistance and provides a corresponding resistor partial voltage according to the reference voltage source;

a plurality of first switches, each of the plurality of the first switches comprises:

a first end, coupled to a corresponding resistor of the plurality of the first resistor series, for receiving the corresponding resistor partial voltage provided by the corresponding resistor;

a second end, coupled to the first input end of the operational amplifier; and a control end, coupled to the first decoder, for receiving a corresponding first decoded signal of the plurality of first decoded signals;

wherein the first switch couples the first end of the first switch to the second end of the first switch according to the received first decoded signal so as to transmit the corresponding resistor partial voltage to the first input end of the operational amplifier;

wherein a resistor partial voltage transmitted from one of the plurality of first switches to the operational amplifier is served as the first gamma voltage;

wherein the gray level signal and the first gamma voltage are conformed to the first gamma curve;

an operational amplifier, comprising:

a first input end, coupled to the gamma voltage conversion circuit, for receiving the first gamma voltage;

a second input end; and an output end;

wherein the operational amplifier outputs the first gamma voltage or a second gamma voltage as the gamma driving voltage according to the first input end of the operational amplifier and the second input end of the operational amplifier;

wherein the gray level signal and the second gamma voltage are conformed to the second gamma curve; and a gamma voltage adjusting circuit, coupled between the second input end of the operational amplifier and the output end of the operational amplifier, for controlling the operational amplifier outputting the first gamma voltage or the second gamma voltage as the gamma driving voltage according to the gray level signal and a gamma curve selection signal.

2. The gamma voltage conversion device of claim 1, wherein the first decoder is realized with a plurality of AND gates.

3. The gamma voltage conversion device of claim 2, wherein input ends of the plurality of AND gates of the first decoder are utilized for receiving the gray level signal, and an output end of one of the plurality of AND gates of the first decoder is utilized for outputting a corresponding first decoded signal.

4. A gamma voltage conversion device for generating a gamma driving voltage according to a gray level signal, the gray level signal and the gamma driving voltage are conformed to a first gamma curve or a second gamma curve, the gamma voltage conversion device comprising:

a gamma voltage conversion circuit for generating a first gamma voltage according to the gray level signal;

wherein the gray level signal and the first gamma voltage are conformed to the first gamma curve;

an operational amplifier, comprising:

a first input end, coupled to the gamma voltage conversion circuit, for receiving the first gamma voltage;

a second input end; and an output end;

wherein the operational amplifier outputs the first gamma voltage or a second gamma voltage as the gamma driving voltage according to the first input end of the operational amplifier and the second input end of the operational amplifier;

wherein the gray level signal and the second gamma voltage are conformed to the second gamma curve; and a gamma voltage adjusting circuit, coupled between the second input end of the operational amplifier and the output end of the operational amplifier, for controlling the operational amplifier outputting the first gamma voltage or the second gamma voltage as the gamma driving voltage according to the gray level signal and a gamma curve selection signal, the gamma voltage adjusting circuit comprising:

a first resistor with a first resistance, coupled between the second input end of the operational amplifier and the output end of the operational amplifier;

a second switch, coupled between the second input end of the operational amplifier and the output end of the operational amplifier, for coupling the second input end of the operational amplifier to the output end of the operational amplifier according to the gamma curve selection signal; and a variable resistance circuit, coupled between the operational amplifier and a ground end, for generating a second resistance according to the gray level signal;

wherein the relation between the second gamma voltage and the first gamma voltage can be represented by a formula below:

$V_{G2}=(1+R_1/R_2)\times V_{G1}$, wherein $V_{G2}$ represents the second gamma voltage, $V_{G1}$ represents the first gamma voltage, $R_1$ represents the first resistance, and $R_2$ represents the second resistance.

5. The gamma voltage conversion device of claim 4, wherein the variable resistance circuit comprises:

a second resistor series, coupled to the second input end of the operational amplifier, the second resistor series comprising a plurality of resistor connected in series;

wherein each resistor of the second resistor series has a predetermined resistance;

a second decoder, coupled to the first decoder, for receiving the plurality of first decoded signals so as to generate a plurality of second decoded signals;

a plurality of third switches, each of the plurality of the third switches comprises:

a first end, coupled to a corresponding resistor of the second resistor series;

a second end, coupled to the ground end, and a control end, coupled to the second decoder, for receiving a corresponding second decoded signal of the plurality of second decoded signals;

wherein the third switch couples the first end of the third switch to the second end of the third switch according to the received second decoded signal so as to coupled the corresponding resistor of the second resistor series to the ground end;

wherein one of the plurality of third switches couples a corresponding resistor of the second resistor series to the ground end so that the sum of resistances of the resistors of the second resistor series, which are the resistors before the resistor coupled to the ground end, is the second resistance.

6. The gamma voltage conversion device of claim 5, wherein the second decoder is realized with a plurality of OR gates.

7. The gamma voltage conversion device of claim 6, wherein each of input ends of the plurality of OR gates of the second decoder is coupled to an output end of a corresponding AND gate of the first decoder, and the each of output ends of the plurality of OR gates is utilized for outputting a corresponding second decoded signal.

8. A gamma voltage conversion device for generating a gamma driving voltage according to a gray level signal, the gray level signal and the gamma driving voltage are conformed to a first gamma curve or a second gamma curve, the gamma voltage conversion device comprising:

a gamma voltage conversion circuit for generating a first gamma voltage according to the gray level signal, comprising:

a first decoder for receiving the gray level signal so as to accordingly generate a plurality of first decoded signals;

a first resistor series, coupled between a reference voltage source and a ground end, the first resistor series comprising a plurality of resistors connected in series;

wherein each resistor of the plurality of the resistors of the first resistor series has a predetermined resistance and provides a corresponding resistor partial voltage according to the reference voltage source;

a plurality of first switches, each of the plurality of the first switches comprises:

a first end, coupled to a corresponding resistor of the plurality of the first resistor series, for receiving the corresponding resistor partial voltage provided by the corresponding resistor;

a second end, coupled to the first input end of the operational amplifier; and a control end, coupled to the first decoder, for receiving a corresponding first decoded signal of the plurality of first decoded signals;

wherein the first switch couples the first end of the first switch to the second end of the first switch according to the received first decoded signal so as to transmit the corresponding resistor partial voltage to the first input end of the operational amplifier;

wherein a resistor partial voltage transmitted from one of the plurality of first switches to the operational amplifier is served as the first gamma voltage;

wherein the gray level signal and the first gamma voltage are conformed to the first gamma curve;

an operational amplifier, comprising:

a first input end, coupled to the gamma voltage conversion circuit, for receiving the first gamma voltage;

a second input end; and an output end;

wherein the operational amplifier outputs the first gamma voltage or a second gamma voltage as the gamma driving voltage according to the first input end of the operational amplifier and the second input end of the operational amplifier;

wherein the gray level signal and the second gamma voltage are conformed to the second gamma curve; and a gamma voltage adjusting circuit, coupled between the second input end of the operational amplifier and the output end of the operational amplifier, for controlling the operational amplifier outputting the first gamma voltage or the second gamma voltage as the gamma driving voltage according to the gray level signal and a gamma curve selection signal, the gamma voltage adjusting circuit comprising:

a first resistor with a first resistance, coupled between the second input end of the operational amplifier and the output end of the operational amplifier;

a second switch, coupled between the second input end of the operational amplifier and the output end of the operational amplifier, for coupling the second input end of the operational amplifier to the output end of the operational amplifier according to the gamma curve selection signal; and a variable resistance circuit, coupled between the operational amplifier and a ground end, for generating a second resistance according to the gray level signal;

wherein the relation between the second gamma voltage and the first gamma voltage can be represented by a formula below:

$V_{G2}=(1+R_1/R_2)\times V_{G1}$, wherein $V_{G2}$ represents the second gamma voltage, $V_{G1}$ represents the first gamma voltage, $R_1$ represents the first resistance, and $R_2$ represents the second resistance.

9. The gamma voltage conversion device of claim 8, wherein the first decoder is realized with a plurality of AND gates.

10. The gamma voltage conversion device of claim 9, wherein input ends of the plurality of AND gates of the first decoder are utilized for receiving the gray level signal, and an output end of one of the plurality of AND gates of the first decoder is utilized for outputting a corresponding first decoded signal.

11. The gamma voltage conversion device of claim 8, wherein the variable resistance circuit comprises:

a second resistor series, coupled to the second input end of the operational amplifier, the second resistor series comprising a plurality of resistor connected in series;

wherein each resistor of the second resistor series has a predetermined resistance;

a second decoder, coupled to the first decoder, for receiving the plurality of first decoded signals so as to generate a plurality of second decoded signals;

a plurality of third switches, each of the plurality of the third switches comprises:

a first end, coupled to a corresponding resistor of the second resistor series;

a second end, coupled to the ground end, and a control end, coupled to the second decoder, for receiving a corresponding second decoded signal of the plurality of second decoded signals;

wherein the third switch couples the first end of the third switch to the second end of the third switch according to the received second decoded signal so as to coupled the corresponding resistor of the second resistor series to the ground end;

wherein one of the plurality of third switches couples a corresponding resistor of the second resistor series to the ground end so that the sum of resistances of the resistors of the second resistor series, which are the resistors before the resistor coupled to the ground end, is the second resistance.

12. The gamma voltage conversion device of claim 11, wherein the second decoder is realized with a plurality of OR gates.

13. The gamma voltage conversion device of claim 12, wherein each of input ends of the plurality of OR gates of the second decoder is coupled to an output end of a corresponding AND gate of the first decoder, and the each of output ends of the plurality of OR gates is utilized for outputting a corresponding second decoded signal.

* * * * *